United States Patent [19]

Yajima et al.

[11] 4,141,726

[45] Feb. 27, 1979

[54] METHOD FOR PRODUCING COMPOSITE MATERIALS CONSISTING OF CONTINUOUS SILICON CARBIDE FIBERS AND BERYLLIUM

[75] Inventors: Seishi Yajima; Masaaki Hamano, both of Oharai, Japan

[73] Assignee: The Research Institute for Iron, Steel and Other Metals of the Tohoku University, Sendai, Japan

[21] Appl. No.: 784,316

[22] Filed: Apr. 4, 1977

[51] Int. Cl.[2] ..... B22F 1/00; B22F 3/00

[52] U.S. Cl. ..... 75/229; 75/DIG. 1; 75/204; 75/236; 428/567

[58] Field of Search ..... 75/DIG. 1, 229, 204, 75/236; 428/567

[56] References Cited

U.S. PATENT DOCUMENTS 3,364,975 1/1968 Gruber ..... 75/DIG. 1

FOREIGN PATENT DOCUMENTS 2236078 3/1974 Fed. Rep. of Germany.

*Primary Examiner*—Brooks H. Hunt

*Attorney, Agent, or Firm*—Ladas, Parry, Von Gehr, Goldsmith & Deschamps

[57] ABSTRACT

Beryllium composite material reinforced with continuous silicon carbide fibers is obtained by bonding tightly continuous silicon carbide fibers obtained by baking spun fibers of organosilicon high molecular weight compound, with beryllium and its alloys as a matrix. The silicon carbide fiber-beryllium composite material is excellent in the mechanical strength, heat resistance and oxidation resistance, and is useful as a material for aerospace instrument and a material for nuclear industry.

10 Claims, No Drawings

METHOD FOR PRODUCING COMPOSITE MATERIALS CONSISTING OF CONTINUOUS SILICON CARBIDE FIBERS AND BERYLLIUM

The present invention relates to a method for producing beryllium composite materials consisting of beryllium metal or beryllium alloy as a matrix and continuous silicon carbide fibers bonded tightly to the matrix.

Particularly, the present invention relates to a method for producing beryllium composite materials reinforced with continuous silicon carbide fibers, which are formed by bonding tightly continuous silicon carbide fibers having very high hardness, mechanical strength at high temperature, wear resistance, heat resistance, oxidation resistance and corrosion resistance, with a matrix consisting mainly of beryllium, and having excellent properties inherent to both of beryllium and silicon carbide fibers.

Beryllium metal has a low density of 1.85 g/cm$^3$, a melting point of 1,285° C., which is considerably higher than that of other light metals, and a relatively high thermal conductivity. Therefore, beryllium metal is expected to be used as heat-resistant light weight materials, such as structural materials for aerospace instruments and the like. Moreover, beryllium metal is small in the cross-sectional area for absorbing neutron and is large in the cross-sectional area for scattering neutron, and therefore beryllium metal is utilized in the nuclear industry as a neutron moderator, a neutron-reflecting material or a covering material for fuel. However, beryllium metal is poor in the hardness and particularly in the mechanical strength at high temperature, and the use of beryllium metal as the above described materials has been very limited. In order to obviate these drawbacks of beryllium metal, it has been attempted that a small amount of Ca, Ni, Fe, Cu or Ag is added to beryllium metal to remove oxygen effectively in the resulting alloy, to strengthen the alloy by the solid solution or by the particle dispersion and to improve the tensile strength, ductility and malleability of the alloy. However, the strength and elongation of these beryllium alloys are at most several times of those of beryllium metal. Moreover, materials for aerospace instrument are required to have a high tensile strength at high temperatures, a high creep rupture strength and a high resistance against transmission of crack, but when beryllium is merely alloyed with the above described metals, the resulting beryllium alloy is still insufficient for practical purpose.

Accordingly, fiber-reinforced materials using beryllium as a matrix have been developed, but proper reinforcing material to be combined with beryllium has not yet been found out, and only composite materials composed of carbon fibers and beryllium have been produced for trial. There are two kinds in these composite materials. The one is produced by immersing carbon fibers in melted beryllium, and the other is produced by sintering a mixture of carbon fibers and beryllium powder. In the composite material produced by the immersing method, since beryllium erodes and reacts with carbon to form $Be_2C$, the properties of carbon fibers are deteriorated to lower the mechanical property of the composite material. Therefore, it is necessary that carbon fibers must be subjected to coating treatment or chemical treatment in order to prevent the erosion of beryllium, and the production step is complicated, and the production cost is high. That is, the immersing method is very disadvantageous in the practical production of the composite material. While, in the composite material produced by the sintering method, carbon fibers are separated from beryllium due to the residual stress by heating to cause breakage of the bonding between the carbon fibers and beryllium, and carbon fibers themselves are often broken into pieces. Therefore, the composite material cannot be practically used. The composite materials of carbon fibers and beryllium metal have a serious drawback as described above, and carbon fibers themselves are very poor in the oxidation resistance at high temperature and the fibrous product made of carbon is extremely ununiform in the mechanical property. Therefore, even when the above described drawbacks of the composite material of beryllium and carbon fibers would be overcome in the future investigation, beryllium composite materials reinforced with such carbon fibers have the above described drawbacks of carbon fibers as such, and cannot be used for practical purpose.

It is an object of the present invention to provide a method of producing an SiC-Be composite material having a high strength by using continuous silicon carbide fibers having very excellent hardness, mechanical strength at high temperature, oxidation resistance, corrosion resistance as a reinforcing material.

In the present invention, silicon carbide fibers are used based on the following reason. The adhesion of silicon carbide to beryllium is excellent due to their wettability, and a reaction of silicon carbide with beryllium, which causes the change of properties of silicon carbide and beryllium themselves, does not occur. The above properties are very advantageous for the production of the composite material of the present invention, and is one of the merits of the present invention.

In the present invention, use is made of continuous fibers consisting mainly of $\beta$-SiC obtained by baking spun fibers consisting mainly of organosilicon high molecular weight compound as explained later. The silicon carbide fibers can be relatively easily produced as explained later, and moreover the fibers are homogeneous, and are made into optional size and length, and the strength and Young's modulus thereof are remarkably superior to those of conventional silicon carbide fibers.

There are three kinds of conventional continuous silicon carbide fibers produced in the following manner.

(a) Silicon carbide formed by a chemical vapor deposition of organosilicon compound and hydrogen, and of silicon chloride and hydrocarbon is coated on W/B fibers obtained by coating boron on a tungsten core wire.

(b) A bundle consisting of about 10,000 rayon fibers is hydrated, and then dipped in silicon chloride, and the above treated fiber bundle is thermally decomposed and siliconized.

(c) Silazane-containing compound consisting of halogenosilane and ammonia is chemically treated so that the compound can be spun into fibers, and the resulting spun fibers are heated under an inert atmosphere to obtain continuous fibers consisting of a homogeneous mixture of silicon carbide and silicon nitride.

However, since the fibers of the type (a) contains tungsten core, the fiber has a diameter as large as at least 100 $\mu$m and a high density of at least 10 g/cm$^3$ and are poor in the flexibility. Moreover, since the strength and modulus of the fiber depend upon those of tungsten core, the strength and elastic modulus of the fibers are fairly low, and therefore the specific strength and specific modulus of the fibers are considerably lower than those of the continuous silicon carbide fibers to be used in the present invention. Further, the chemical vapor deposition method requires a complicated step, and the fibers are expensive.

In the fibers of type (b), silicon tetrachloride and hydrochloric acid, which is generated during the production step, are handled during the production step, and therefore the production step is complicated and there are many problems in the safety maintenance. Moreover, since this production method starts from a bundle of rayon fibers, individual fibers are difficultly taken out. Further, the strength and modulus of the fibers are as low as 1/3–1/5 of those of the silicon carbide fibers to be used in the present invention. Therefore, it is very disadvantageous to use the fibers of type (b) for reinforcing composite material.

In the fibers of type (c), very complicated step is required in the production of spun fibers, and therefore the production cost of the fiber is high and the tensile strength of the fiber is 60–115 kg/mm$^2$ and the modulus thereof is $(9–10)\times10^3$ kg/mm$^2$, which are as low as about 1/3–1/4 of the tensile strength and modulus of the silicon carbide fibers of the present invention. Therefore, it is very disadvantageous to use the fibers of type (c) for reinforcing composite material.

On the contrary, the continuous silicon carbide fibers to be used in the present invention can be obtained inexpensively by a simpler production step than the above described conventional fibers (a), (b) and (c), as described later. Moreover, the fibers can be obtained in the form of homogeneous and continuous fibers having optional diameter and length, and the fibers are very excellent in the strength and modulus. That is, the fibers are most suitable to be used as a reinforcing fiber for composite material. Therefore, the use of the fibers in the production of beryllium composite material is the essential feature of the present invention.

The materials to be used as a matrix of the composite material in the present invention include not only beryllium metal alone but also the following strengthened beryllium alloys. The strengthened beryllium alloys are beryllium alloy having an improved ductility obtained by effective removing of oxygen in Be by Ca addition; beryllium alloy having an improved strength, which consists of Be and a small amount of metal such as Cu, Ni, Ag, Fe or the like, which forms a solid solution with Be; beryllium alloy which consists of Be and a small amount of metal such as Ni or the like, and has a stabilized crystal phase of Be; and beryllium alloy having an improved strength, which consists of Be and at least one metal of Mn, Cr, Mo, W, Co, Zr, Nb and Y, in which an intermetallic compound of these metals with Be are dispersed in Be, and the like. These strengthened beryllium alloys contain 0.1–30% by weight of the above described metal element other than beryllium, and can be advantageously used in the present invention.

The present invention will now be explained in more detail.

The fibers to be used for reinforcing beryllium composite material in the present invention are continuous fibers having a high strength, which consist mainly of silicon carbide obtained by baking spun fibers consisting mainly of organosilicon high molecular weight compound. In the present invention, a SiC-Be composite material, which has a high strength, can be obtained by bonding tightly the fibers with beryllium metal or beryllium alloy consisting mainly of beryllium.

The above described continuous silicon carbide fibers are produced by the production method disclosed in U.S. patent application Ser. No. 677,960 already filed by the inventors of the present invention. In the production of the fibers, the organosilicon compounds of the following groups (1)–(10) are used as the starting material.

(1) Compounds having only Si—C bond.
(2) Compounds having Si—H bond in addition to Si—C bond.
(3) Compounds having Si—Hal bond.
(4) Compounds having Si—N bond.
(5) Compounds having Si—OR (R is alkyl or aryl group) bond.
(6) Compounds having Si—OH bond.
(7) Compounds having Si—Si bond.
(8) Compounds having Si—O—Si bond.
(9) Esters of organosilicon compounds.
(10) Peroxides of organosilicon compounds.

From at least one of the organosilicon low molecular weight compounds belonging to the above described groups (1)–(10), organosilicon high molecular weight compounds having silicon and carbon as the main skeleton components, for example, the compounds having the following molecular structures, are produced by polycondensation reaction using at least one process of irradiation, heating and addition of a catalyst for the polycondensation.

(a) 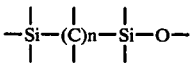

(b) 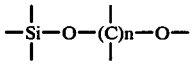

(c) 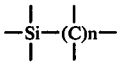

(d) The compounds having the above described skeleton components (a)–(c) as at least one of partial structures in linear, ring and three dimensional structures or mixtures of the compounds having the above described skeleton components (a)–(c).

From an organosilicon high molecular weight compound containing at least one of the above described molecular structures (a)–(d), or from an organosilicon high molecular weight compound containing a small amount of metal element, which is produced by polymerizing a mixture of at least one of the above described compounds (1)–(10) with a small amount of organometallic compound, is prepared a spinning liquid and then the spinning liquid can be spun into fibers having various lengths and uniform fineness. The spun fibers are heated at a low temperature within a temperature range of 50°–400° C. under an oxidizing atmosphere and then preliminarily heated at a temperature of 600°–1,000° C. under at least one atmosphere of vacuum, inert gases, CO gas, hydrocarbon compound gas, organosilicon compound gas and hydrogen gas to form preliminarily heated continuous silicon carbide fibers. However, the above described preliminary heating is able to get along even under the above described atmosphere containing at least one of an oxidizing gas and hydrocarbon compound gas in a partial pressure of less than 10 mmHg. The above described preliminarily heated fibers are baked at a temperature of 1,000°–2,000° C. under at least one of atmosphere of vacuum, air, oxygen gas, inert gas, CO gas, hydrocarbon compound gas, organosilicon compound gas and hydrogen gas to form continuous silicon carbide fibers consisting mainly of $\beta$-SiC.

Properties of one of the most excellent continuous silicon carbide fibers obtained by baking the spun fiber made from the starting material (7) and having the molecular structure of (c) at 1,300° C. under vacuum in the above described method invented by the inventors of the present invention are shown in the following Table 1.

Table 1

| | |
|---|---|
| Crystal grain size | average diameter 33 Å |
| Density | 2.5 – 2.9 g/cm$^3$ |
| Hardness | 9 (Mohs) |
| Tensile strength | 200 – 400 kg/mm$^2$ |
| Young's modulus | (2.0 – 4.0)$\times 10^4$ kg/mm$^2$ |
| Oxidation resistance | Even if the fibers are kept at 1,300 ° C for 100 hours in air, the weight variation is not observed. |
| Thermal shock resistance | Even if rapid heating and quenching cycle of 25° C→←1,000° C is repeated more than 1,000 times, the texture does not vary. |

Further, the above described silicon carbide fibers obtained by baking spun fibers consisting mainly of organosilicon high molecular weight compound contain usually more than 0.01% by weight of free carbon. The amount of free carbon contained in the fibers varies depending upon the baking temperature, baking time, baking atmosphere and other conditions. This free carbon probably reacts locally with beryllium metal at a high temperature of higher than 1,200° C. to form a very small amount of compounds such as $Be_2C$ on the boundary surface of the silicon carbide fibers and beryllium metal. As the result, silicon carbide fibers are bonded to beryllium metal more tightly not only by the adhesion of the silicon carbide fibers and beryllium metal due to the wettability and mutual diffusion of the fibers and beryllium metal, but also by the adhesion of the fibers and beryllium due to the local chemical reaction of the free carbon with beryllium at the boundary surface of the fibers and beryllium. Therefore, the above described free carbon has a very important role in the bonding of SiC-Be in the present invention. The silicon carbide fibers to be used in the present invention have a crystal grain size of not larger than 1,000 Å, generally about several tens Å as shown in Table 1, and therefore the number of microscopic unevenness in unit area of the fiber surface is very large, and so when melted or softened beryllium metal goes into the unevenness, the reaction cross-sectional area for the wettability and mutual diffusion of the fibers and beryllium metal is increased, and the adhesion of the fibers and beryllium metal becomes very strong. This is one of the merits of the present invention. As described above, the fibers to be used in the present invention are most suitable starting materials for the production of beryllium composite material having a high strength due to the tight adhesion of the fibers and beryllium. The present invention has been accomplished based on this acknowledgement.

As the method for producing composite material composed of the silicon carbide fibers and beryllium metal or beryllium alloy of the present invention, use may be made of commonly used various methods for producing metal-fiber composite material. However, the following four methods are advantageously used in the present invention.

(a) Melted matrix material is permeated into spaces between uniformly arranged fiber bundles under vacuum or an inert atmosphere.

(b) An assembly composed of powders of matrix material and fibers is sintered or hot pressed under vacuum or an inert atmosphere to bond tightly the matrix material and fibers.

(c) Foils or thin sheets of matrix material and fibers are regularly superposed and hot pressed or hot rolled under vacuum or an inert atmosphere to diffuse and bond the matrix material and fibers tightly.

(d) Matrix material is coated or sprayed by plasma or the like on each fiber, and the resulting fibers are gathered and hot pressed under vacuum or an inert atmosphere.

According to the above described methods, homogeneous and strong composite material consisting of fibers and matrix material can be obtained with substantially no pores in the boundary of the fibers and matrix material.

It is preferable that the content of silicon carbide fibers in the SiC-Be composite material of the present invention is 5–95% by weight. When the content of silicon carbide fibers is less than 5% by weight, the reinforcing effect of the fibers is poor. While, when the content of the fibers is more than 95% by weight, light weight property and thermal conductivity inherent to beryllium metal or beryllium alloy are lowered in the resulting composite material, and moreover the composite material is poor in the workability.

The following examples are given for the purpose of illustration of this invention.

EXAMPLE 1

Five kinds of silicon carbide fiber-beryllium composite materials containing silicon carbide fibers in an amount shown in the following Table 2 were produced from beryllium metal as a matrix and silicon carbide fibers. The silicon carbide fibers used in this Example 1 and the following Examples were produced from a polycarbosilane syntherized from polysilane which was obtained from dimethyldichlorosilane by thermal polycondensation according to the method disclosed in our copending U.S. patent application Ser. No. 677,960. Bundles of silicon carbide fibers obtained by baking at 1,250° C. in $N_2$ gas and having a thickness of 10–20 $\mu$m and a length of 50 mm were set in an alumina crucible (12$\phi\times$50L mm$^3$), and the crucible was hung at the upper portion of a heating chamber which was connected to a vacuum line of $1\times10^{-3}$ mmHg. Beryllium metal was charged in an alumina vessel and the vessel was placed at the lower portion of the heating chamber. Beryllium metal in the vessel was heated from the exterior of the vessel and melted at about 1,300° C. The crucible was brought down, dipped in the melted beryllium for 1 minute, applied with 5 atmospheric pressure of argon gas for 5 minute, and then brought up. The resulting silicon carbide fiber-beryllium composite material was worked into a rod of 10$\phi\times$40L mm$^3$, which was used as a test piece. Properties of the silicon carbide fiber-beryllium composite materials are shown in Table 2.

Table 2

| Amount of fiber (wt. %) Properties | 10 | 30 | 50 | 70 | 90 |
|---|---|---|---|---|---|
| Density ($g/cm^3$) | 2.0 | 2.2 | 2.4 | 2.7 | 2.9 |
| Average hardness (Mohs) | 6–7 | 7–8 | 7–8 | 8–9 | 8–9 |
| Tensile strength in air ($kg/mm^2$) | | | | | |
| Room temperature | 41–73 | 110–160 | 190–240 | 220–280 | 250–310 |
| 500° C | 30–52 | 88–120 | 130–210 | 170–240 | 200–260 |
| 900° C | 15–40 | 63–99 | 110–160 | 120–180 | 140–200 |
| Oxidation resistance, weight increase in air at 500° C for 50 hrs. (%) | 9–15 | 7–10 | 3–6 | 1–3 | ~1 |
| Thermal conductivity (cal/cm·sec·° C) | 0.30 –0.35 | 0.22–0.27 | 0.14–0.18 | 0.11–0.17 | 0.10–0.14 |

As seen from Table 2, the beryllium composite material reinforced with continuous silicon carbide fibers is higher in the hardness and strength with the increase of the fiber content. However, the composite material is higher in the density and lower in the thermal conductivity with the increase of the fiber content. Therefore, the composite material containing 30–70% by weight of the fibers are suitable as materials for aerospace industry and the like. When the composite material was cut and the adhesion between the silicon carbide fibers and beryllium was observed by a microscope, pores were not substantially observed, but a very thin-layered texture other than silicon carbide and beryllium was observed on the fiber surface. This thin layer is probably $Be_2C$ or a compound of Be-Si-C system. It can be easily understood from the result of the measurement of various properties that the presence of this thin layer does not lower the mechanical property of the composite material, but rather more improves the adhesion of silicon carbide fibers with beryllium.

EXAMPLE 2

Bundles, each composed of 20–30 silicon carbide fibers obtained by baking at 1,300° C. in $N_2$ gas and having a fineness of 10–20 μm, were embedded to be arranged in one direction, in beryllium metal powders having a particle size of not larger than 200 meshes and the resulting assembly was press molded by means of a mold press under a pressure of 500 $kg/cm^2$ to produce a prism-shaped green pellet of $10\times10\times40$ $mm^3$ having a weight ratio of the matrix to the fibers of 30/70, in which the arranging direction of the fiber bundles was parallelled to the longitudinal direction of the green pellet. The green pellet was sintered at 1,200° C. for 2 hours under argon atmosphere kept at 1 atm. The obtained composite material has a hardness of about 7 mohs. Further, the mechanical property and oxidation resistance of the composite material were substantially the same as the middle values of the composite materials containing 10% and 30% by weight of silicon carbide fibers in Table 2. Microscopic observation of the composite material showed that a very small amount of pores were present in the interior of the composite material. However, silicon carbide fibers were tightly adhered to beryllium, and the composite material obtained by sintering under normal pressure can be satisfactorily used practically.

When the above described green pellet was hot pressed at 1,200° C. for 30 minutes under a pressure of 200 $kg/cm^2$ in argon atmosphere, the above described pores were not substantially observed in the resulting composite materials, and the properties of the composite material were substantially same as those of the composite material containing 30% of silicon carbide fibers in Table 2.

Further, when 98Be-2Cu alloy, 97Be-3Ni alloy or 95Be-5Co alloy was used as a matrix, substantially the same results as described above were also obtained.

EXAMPLE 3

A square foil having a dimension of $30\times30$ $mm^2$ and a thickness of 0.05 mm which consisted of 99 wt.% Be-1 wt.% Ag alloy and a layer formed of one-directionally arranged silicon carbide fibers obtained by baking at 1,300° C. in vacuum and having a thickness of 10–20 μm and a length of 30 mm were alternately superposed to produce a laminate having a thickness of 2 mm and containing 15% by weight of the silicon carbide fibers. The laminate was hot pressed at 1,250° C., which is 35° C. lower than the melting point of beryllium, for 30 minutes under a pressure of 200 $kg/cm^2$ in argon atmosphere to obtain a composite material composed of the silicon carbide fibers and the beryllium alloy. The composite material has a thickness of about 1.5 mm and a density of about 2.0 $g/cm^3$. Microscopic observation of the composite material showed that the beryllium alloy had been softened and permeated into spaces between the layered silicon carbide fibers, and there were substantially neither reaction product of the silicon carbide and beryllium alloy, nor pores.

The composite material had substantially the same as or somewhat superior to the composite material containing 10% by weight of silicon carbide fibers in Table 2 in the mechanical property and other properties. According to the method for producing composite material of this Example, thin sheet of SiC-Be composite material reinforced with silicon carbide fibers can be obtained, and the composite material can be formed into various shapes by bend-working and cutting.

EXAMPLE 4

Silicon carbide fibers obtained as described in Example 1, having a length of 30 mm, were arranged plainly, and to which beryllium was coated by plasma spray. The spraying was repeated three times respectively on the upper and lower sides of the fibers plainly arranged. Each of the above treated fibers composed of silicon carbide and beryllium had a diameter of 0.1–0.5 mm. Ten layers of the plainly arranged fibers were placed in a graphite die and hot pressed at 1,240° C. for 1 hour under a pressure of about 200 $kg/cm^2$ in argon atmosphere of 1 atm. The amount of silicon carbide fibers contained in the resulting beryllium composite material was about 50% by weight, and the properties thereof were substantially the same as those of the beryllium composite material containing 50% by weight of silicon carbide fibers in Table 2. The resulting composite material contained substantially few pores.

The above Examples show typical methods for producing beryllium composite material reinforced continuous silicon carbide fibers and typical shapes of the resulting composite material. However, the composite materials having various shapes can be obtained in various methods according to the present invention.

As described above, according to the present invention, beryllium composite material reinforced with silicon carbide fibers, which has a high density and has excellent mechanical property, heat resistance and oxidation resistance, can be obtained, and the composite material is expected to be advantageously used not only as a material for aerospace instrument and a material for nuclear industry, but also in various fields.

What is claimed is:

1. A method for producing beryllium composite materials reinforced with continuous silicon carbide fibers, comprising arranging 5–95% by weight of tightly continuous fibers consisting mainly of silicon carbide obtained by baking spun fibers consisting mainly of organosilicon high molecular weight compound containing at least 0.01% by weight of free carbon a melted matrix consisting mainly of beryllium to react the free carbon contained in the silicon carbide fibers with beryllium to form beryllium carbide and the melted matrix material permeates into spaces between the fibers under vacuum or an inert atmosphere to bond tightly the fibers to the matrix.

2. A method according to claim 1, wherein said matrix is at least one member selected from beryllium and alloys of beryllium with calcium, tungsten, molybdenum, iron, cobalt, nickel, chromium, silver, copper, manganese, zirconium, niobium and yttrium.

3. A method according to claim 2, wherein the amount of the metal to be alloyed with beryllium is 0.1-30% by weight based on the weight of the alloy.

4. A method according to claim 1, wherein said spun fibers are produced from organosilicon high molecular weight compounds having silicon and carbon as the main skeleton components, which are produced from at least one of organosilicon low molecular weight compounds of the following groups (1)–(10), (1) Compounds having only Si—C bond,
(2) Compounds having Si—H bond in addition to Si—C bond,
(3) Compounds having Si—Hal bond,
(4) Compounds having Si—N bond,
(5) Compounds having Si—OR (R is alkyl or aryl group) bond,
(6) Compounds having Si—OH bond,
(7) Compounds having Si—Si bond,
(8) Compounds having Si—O—Si bond,
(9) Esters of organosilicon compounds and
(10) Peroxides of organosilicon compounds, by polycondensation reaction using at least one process or irradiation, heating and addition of a catalyst for the polycondensation.

5. A method according to claim 1, wherein an assembly composed of the matrix and the continuous silicon carbide fibers are sintered or hot pressed under vacuum or an inert atmosphere to bond tightly the matrix to the fibers.

6. A method according to claim 1, foils or thin sheets of the matrix material and the continuous silicon carbide fibers are regularly superposed and hot pressed or hot rolled under vacuum or an inert atmosphere to diffuse and bond the matrix material and the fibers tightly.

7. A method according to claim 1, wherein the matrix material is coated or sprayed by plasma on each of the continuous silicon carbide fibers, and the resulting fibers are gathered and hot pressed under vacuum or an inert atmosphere.

8. A beryllium composite material reinforced with continuous silicon carbide fibers, which consists mainly of the following three components, (a) continuous silicon carbide fibers consisting mainly of $\beta$-type silicon carbide fine particles of less than 1,000 A in diameter obtained by baking spun fibers consisting mainly of organosilicon high molecular weight compound,
(b) beryllium matrix selected from the group consisting of beryllium, beryllium alloys and composites consisting mainly of beryllium, and
(c) a very small amount of carbide which is formed by reacting free carbon contained in the surface of the continuous silicon carbide fibers with the matrix beryllium or beryllium alloys.

9. A beryllium composite material according to claim 8, wherein said beryllium composite material has a high oxidation resistance and has a hardness of 6–9 mohs, a tensile strength of 110–310 kg/mm$^2$ at temperature under 900° C., and a thermal conductivity of (0.22–0.10) cal/cm.sec.degree.

10. A beryllium composite material according to claim 8, which is used as a material for aerospace instrument and a material for nuclear industry.

* * * * *